US010814195B2

(12) United States Patent
Valencia

(10) Patent No.: US 10,814,195 B2
(45) Date of Patent: Oct. 27, 2020

(54) STOMP AND CATCH GAME

(71) Applicant: Michelle D. Valencia, Diamond Bar, CA (US)

(72) Inventor: Michelle D. Valencia, Diamond Bar, CA (US)

( * ) Notice: Subject to any disclaimer, the term of this patent is extended or adjusted under 35 U.S.C. 154(b) by 111 days.

(21) Appl. No.: 15/438,640

(22) Filed: Feb. 21, 2017

(65) Prior Publication Data

US 2018/0236331 A1 Aug. 23, 2018

(51) Int. Cl.

*A63B 69/40* (2006.01)
*A63B 67/06* (2006.01)
*A63B 71/06* (2006.01)

(52) U.S. Cl.

CPC ..... *A63B 67/06* (2013.01); *A63B 69/40* (2013.01); *A63B 2069/401* (2013.01); *A63B 2071/0694* (2013.01)

(58) Field of Classification Search

CPC ..... A63B 65/12; A65B 67/12
USPC ..... 124/4
See application file for complete search history.

(56) References Cited

U.S. PATENT DOCUMENTS 191,628 A * 6/1877 Wilkie ..... A63B 65/12 124/4
1,525,588 A * 2/1925 Moore ..... A63B 65/12 124/4
1,531,105 A * 3/1925 Knowlton ..... A63B 65/12 124/4
1,563,908 A 12/1925 Krause
2,146,156 A 2/1939 Nicot et al.
2,963,016 A * 12/1960 Andis ..... A01K 91/02 124/36
3,208,444 A 9/1965 Sipos
3,662,728 A * 5/1972 Retrum ..... A63B 69/40 124/4
3,669,451 A * 6/1972 Welbourn ..... A63F 9/0252 124/4
4,010,953 A 3/1977 Russo
4,583,743 A 4/1986 Macek
4,813,665 A * 3/1989 Carr ..... A63B 5/22 482/3

(Continued)

OTHER PUBLICATIONS

"Give a Flip: The Hand-Foot Coordination Game", https://funandfunction.com/give-a-flip.html, captured Mar. 31, 2014.*

*Primary Examiner* — Laura Davison
(74) *Attorney, Agent, or Firm* — Nath, Goldberg & Meyer; Richard C. Litman

(57) ABSTRACT

The stomp and catch game is similar to a conventional stomp and catch board, but includes an additional stabilizing base. The base has opposed upper and lower surfaces. The upper surface has at least one first visual indicator formed thereon to indicate where a user should stand with one foot to hold the lower surface of the base against a support surface, such as the ground or a floor. By standing on the base with one foot, the user's weight maintains the base in a stable position while the user plays the game. A pivoting board is pivotally secured to the base. The pivoting board has opposed first and second ends. The first end is configured for stomping on with the user's other foot, and the second end is configured for releasably supporting and launching a target object that the user attempts to catch while in the air.

2 Claims, 3 Drawing Sheets

(56) References Cited

U.S. PATENT DOCUMENTS 5,069,446 A * 12/1991 Larson ..... A63B 23/10
482/51
5,280,922 A * 1/1994 Jones ..... A63B 69/0084
473/426
7,631,876 B1 12/2009 Walterscheid

* cited by examiner

STOMP AND CATCH GAME

BACKGROUND OF THE INVENTION

1. Field of the Invention

The present invention relates to toys and games, and particularly to a stomp and catch game including a stomp and catch board mounted on a stabilizing base.

2. Description of the Related Art

Stomp and catch boards (sometimes also referred to as "launching boards") are relatively simple toy or game boards that are configured like a lever or a simple catapult. A typical stomp and catch board is a lever having one end configured for stomping with the foot and the other end configured to launch a projectile, such as a beanbag. A central fulcrum rests between the lower surface of the board and a support surface, such as the ground, a floor, etc. Such stomp and catch boards are relatively common games used not only for entertainment, but also for providing children with an enjoyable exercise for improving their motor skills, visual acuity, and hand-eye coordination.

The board and fulcrum are typically manufactured as a single unit, allowing the entire game to be easily moved and stored. However, such intentional manufacture of the typical stomp and catch board as a one piece unit also presents potential injury for the user. Since the entire unit rests on the support surface by only the fulcrum and one end of the board, neither of which are fixed to the support surface, the stomp and catch board can easily slip on the support surface, or become misaligned with the user's foot, potentially causing injury to the user's foot or causing the entire stomp and catch board to fly up and strike the user. Thus, a stomp and catch game solving the aforementioned problems is desired.

SUMMARY OF THE INVENTION

The stomp and catch game is similar to a conventional stomp and catch board, but includes an additional stabilizing base. The base has opposed upper and lower surfaces. The upper surface has at least one first visual indicator formed thereon to indicate where a user should stand with one foot to hold the lower surface of the base against a support surface, such as the ground or a floor. By standing on the base with one foot, the child's weight maintains the base in a stable position while the user plays the game.

A pivoting board is pivotally secured to the base. The pivoting board has opposed first and second ends. The first end is configured for stepping on with the user's other foot, and the second end is configured for releasably supporting and launching a target object, such as a beanbag, plush toy or the like, which the user attempts to catch. A fulcrum connector is provided for pivotally attaching a central portion of the pivoting board to the upper surface of the base.

Preferably, first and second pads or cushions are further provided. The first pad is mounted on the upper surface of the base and beneath the first end of the pivoting board, such that the first end of the pivoting board selectively contacts and rests on the first pad. Similarly, the second pad is mounted on the upper surface of the base and beneath the second end of the pivoting board, such that the second end of the pivoting board selectively contacts and rests on the second pad. A second visual indicator is preferably formed on the first end of the pivoting board to indicate where the user should step. Similarly, a third visual indicator is preferably formed on the second end of the pivoting board to indicate where the projectile is releasably supported.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1A:
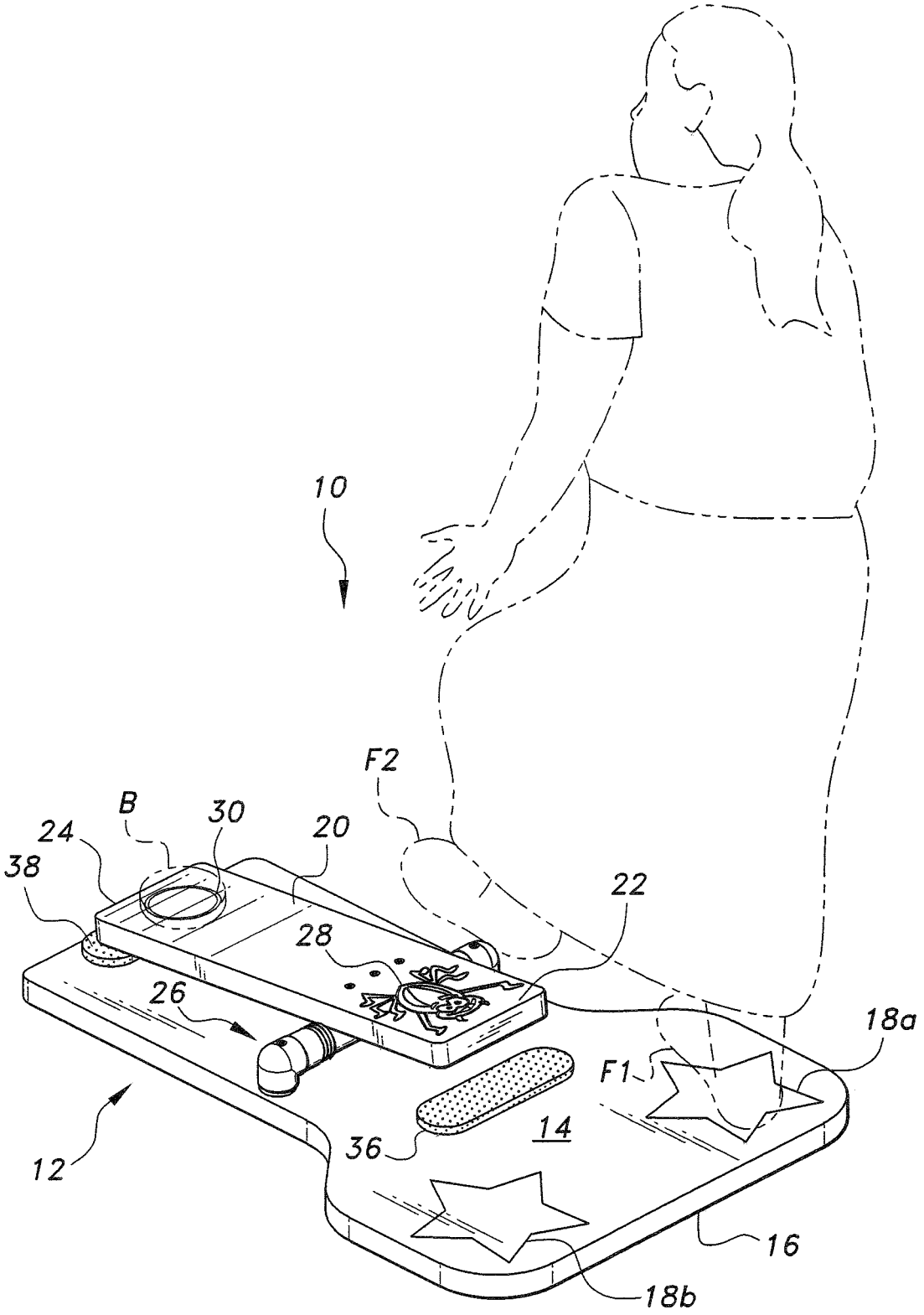
FIG. 1A is an environmental, perspective view of a stomp and catch game according to the present invention, shown before stomping on the pivoting board.
Figure 1B:
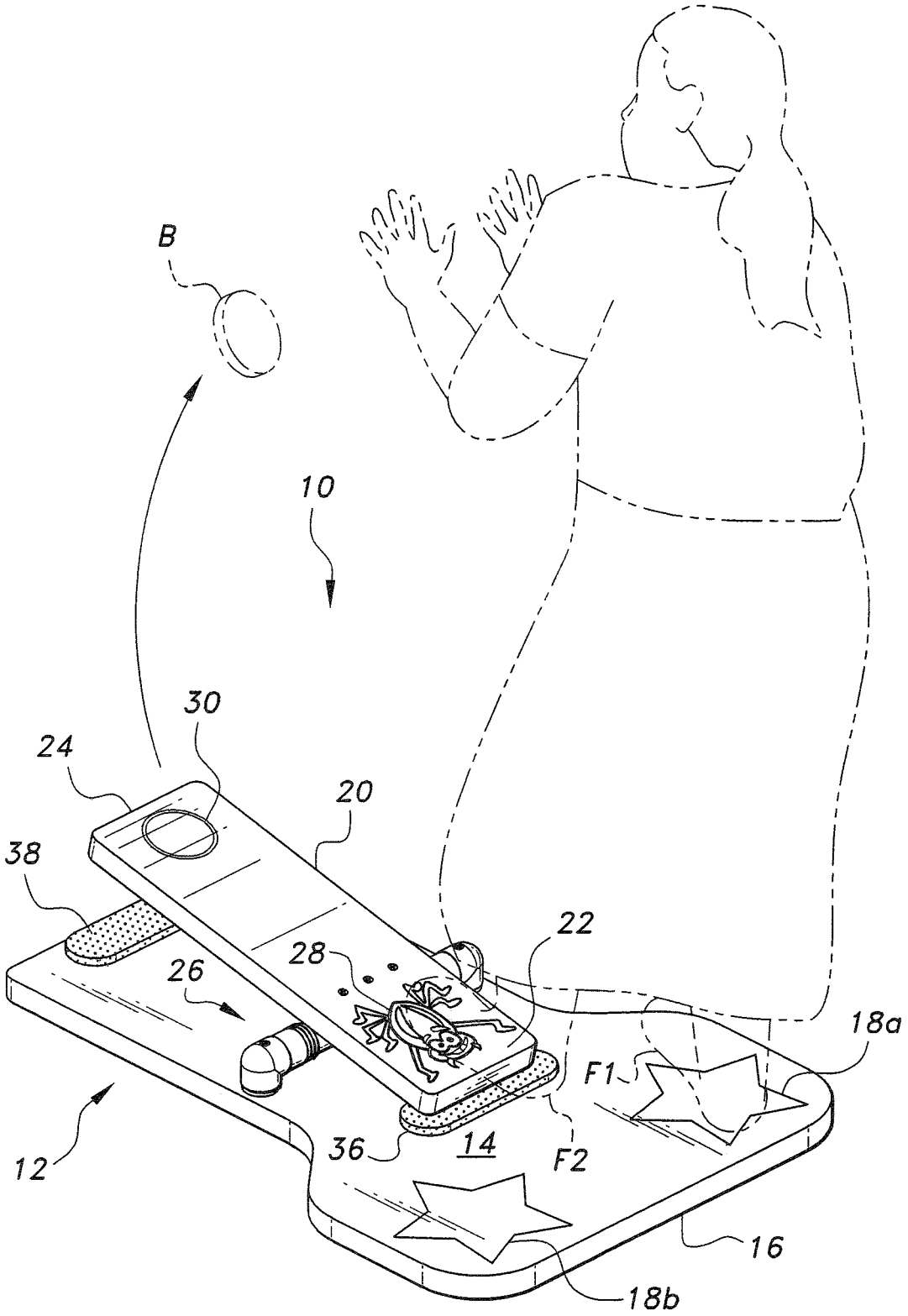
FIG. 1B is an environmental, perspective view of a stomp and catch game of FIG. 1A, shown after stomping on the pivoting board.
Figure 2:
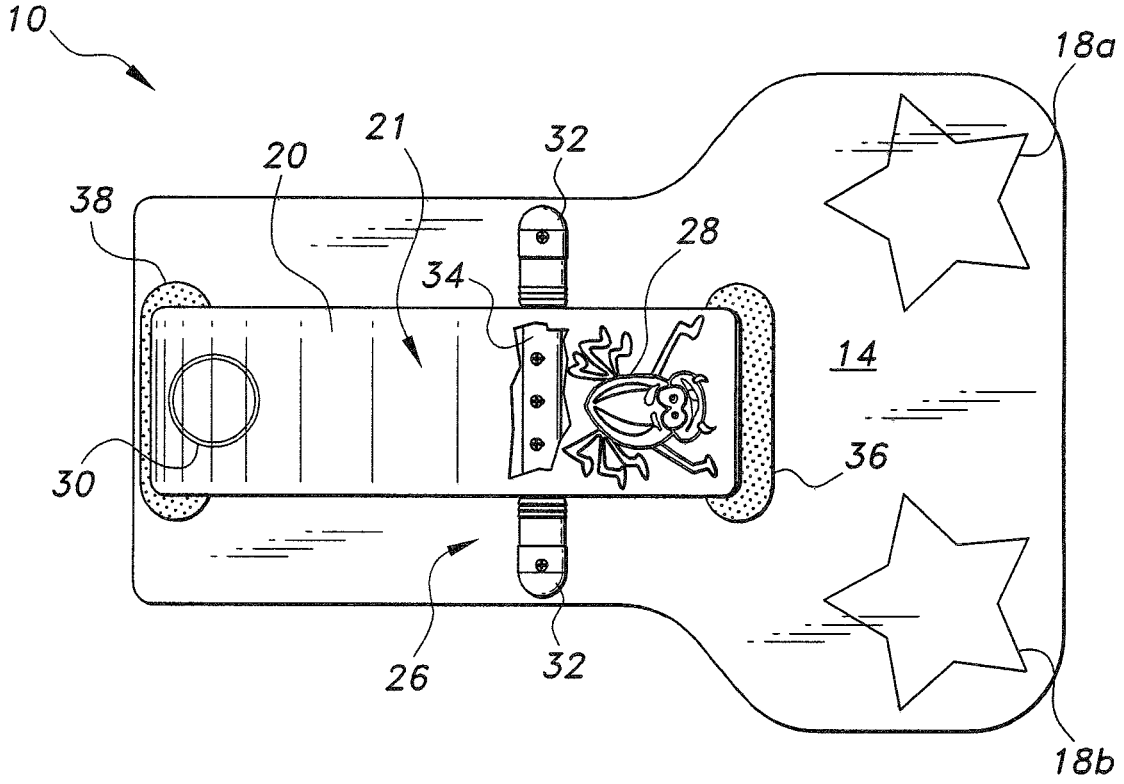
FIG. 2 is a top view of the stomp and catch game of FIG. 1A, shown with the pivoting board partially broken away to show details of the fulcrum.
Figure 3:
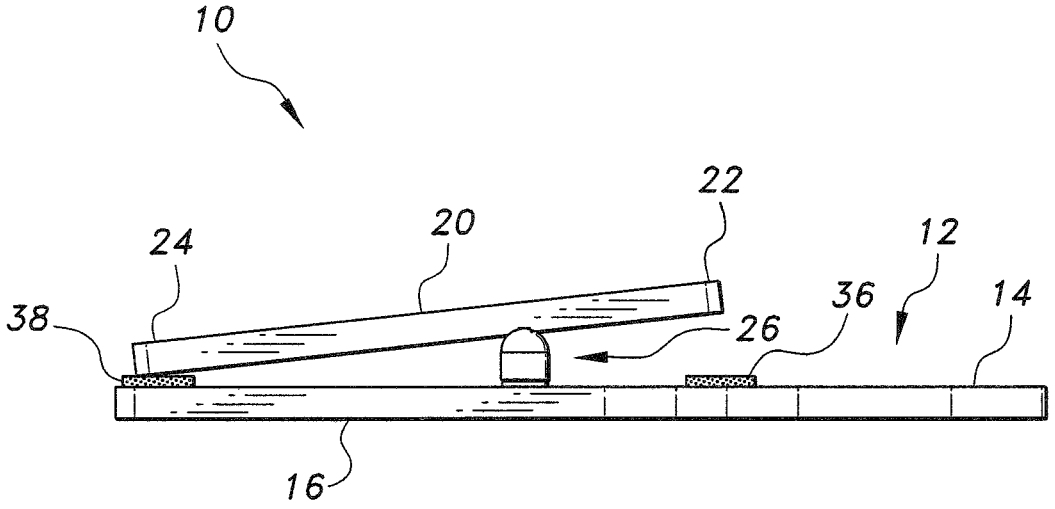
FIG. 3 is a side view of the stomp and catch game of FIG. 1A.

The stomp and catch game 10 is similar to a conventional stomp and catch board, but includes an additional stabilizing base 12. As best shown in FIGS. 1A, 1B, 2 and 3, the base 12 has opposed upper and lower surfaces 14, 16, respectively. The upper surface 14 has at least one first visual indicator formed thereon to indicate where a user should stand with one foot F1 to hold the lower surface 16 of the base 12 against a support surface, such as the ground or a floor. In FIGS. 1A, 1B and 2, a pair of first visual indicators 18*a*, 18*b* are shown. It should be understood that the use of two such first indicators (allowing the user to stand thereon with either the left or right foot), as well as the illustrated star-type shapes thereof, are shown for exemplary purposes only. By standing on the base 12 with one foot F1, the user's weight maintains the base 12 in a stable position while the user plays the game.

A pivoting board 20 is pivotally secured to the base 12. The pivoting board 20 has opposed first and second ends 22, 24, respectively. The first end 22 is configured for stepping on with the user's other foot F2, and the second end 24 is configured for releasably supporting and launching a target object, such as a beanbag B, plush toy or the like, which the user attempts to catch while it is still in the air. It should be understood that beanbag B is shown in FIGS. 1A and 1B for exemplary purposes only. As shown, a second visual indicator 28 may be formed on the first end 22 of the pivoting board 20 to indicate where the user should step with the stomping foot F2. Similarly, a third visual indicator 30 may be formed on the second end 24 of the pivoting board 20 to indicate where the target object B is releasably supported. As with stars 18*a*, 18*b*, it should be understood that the cartoon spider 28 and the circle 30 are shown in FIGS. 1A, 1B and 2 for exemplary purposes only. Additionally, it should be understood that first visual indicators 18*a*, 18*b*, second visual indicator 28, and third visual indicator 30 may be formed by any suitable process, such as imprinting, adhesive decals, painting, engraving or the like.

A fulcrum connector 26 is provided for pivotally attaching a central portion 21 of the pivoting board 20 to the upper surface 14 of the base 12. It should be understood that the fulcrum connector 26 may be any suitable type of pivot, hinge or rotatable connector. As an example, as shown in FIG. 2, the fulcrum connector 26 may include a pair of cuffs 32 or hubs rigidly secured to the upper surface 14 of base 12 on either side of the pivoting board 20. An axle 34 has a pair of opposed ends rotatably mounted or journaled into bearings in the pair of cuffs 32 or hubs, allowing the axle 34 to rotate freely with respect to the stationary cuffs 32. The central portion 21 of the pivoting board 20 is secured to the axle 34 by bolts, screws, rivets, or other suitable fasteners.

Preferably, first and second pads 36, 38 or cushions are also provided. The first pad 36 is mounted on the upper surface 14 of the base 12 and beneath the first end 22 of the pivoting board 20, such that the first end 22 of the pivoting board 20 selectively contacts and rests thereon. Similarly, the second pad 38 is mounted on the upper surface 14 of the base 12 and beneath the second end 24 of pivoting board 20, such that the second end 24 of the pivoting board 20 selectively contacts and rests thereon. It should be understood that the overall configuration and relative dimensions of the first and second pads 36, 38 are shown in FIGS. 1A-3 for exemplary purposes only. The pads 36, 38 dampen noise generated when the opposing ends 22, 24 of the pivoting board 20 strike or impact the base 12, and also help to reduce wear of the base 12 and the pivoting board 20.

It is to be understood that the present invention is not limited to the embodiments described above, but encompasses any and all embodiments within the scope of the following claims.

I claim:

1. A stomp and catch game, consisting of:

a planar base, the planar base consisting of an elongated front portion having a first length and an opposed rear portion having a second length shorter than the first length, opposed planar upper and lower surfaces, the opposed rear portion including a front area and a rear end, the elongated front portion having a front end and a rear area that merges into the front area of the rear portion, the elongated front portion has a first width and the rear portion has a second width larger than the first width to provide an area large enough to allow a user to stand, the rear portion of the upper surface having a pair of visual indicators disposed thereon to indicate where a user should stand with either foot to hold the lower surface of the base against a support surface;

a pivoting board having opposed upper and lower surfaces and opposed first and second ends, wherein the first end is located in a first length portion of the pivoting board and the second end is located in a second length portion of the pivoting board, the first end being configured for stomping on with the user's foot, the second end being configured for releasably supporting and launching a target object in the air for the user to attempt to catch, wherein each of the first and second ends have distinct indicia for indicating where a user stomps and where a user places the target object, respectively, further wherein the second length portion of the pivoting board is greater that the first length portion of the pivoting board;

a fulcrum connector pivotally attaching the pivoting board to the upper surface of the base, wherein the fulcrum connector comprises:

a pair of hubs mounted on the upper surface of the base at the front portion thereof, wherein the pair of hubs are configured to support the lower surface of the pivoting board thereon; and an axle having a pair of opposed ends rotatably mounted in the hubs, the pivoting board being fixed to the axle for rotation therewith;

a first pad mounted on the upper surface of the base adjacent the front area of the rear portion and spaced from the pair of visual indicators, the first pad being located beneath the first end of the pivoting board, such that the first end of the pivoting board selectively contacts and rests on the first pad;

a second pad mounted on the upper surface of the base adjacent the front end of the elongated front portion and beneath the second end of the pivoting board, such that the second end of the pivoting board selectively contacts and rests on the second pad.

2. A stomp and catch game, consisting of:

a planar base, the planar base consisting of an elongated front portion having a first length and an opposed rear portion having a second length shorter than the first length, opposed planar upper and lower surfaces, the opposed rear portion including a front area and a rear end, the elongated front portion having a front end and a rear area that merges into the front area of the rear portion, the elongated front portion has a first width and the rear portion has a second width larger than the first width to provide an area large enough to allow a user to stand, the rear portion of the upper surface having a pair of visual indicators disposed thereon to indicate where a user should stand with either foot to hold the lower surface of the base against a support surface;

a pivoting board having opposed upper and lower surfaces and opposed first and second ends, wherein the first end is located in a first length portion of the pivoting board and the second end is located in a second length portion of the pivoting board, the first end being configured for stomping on with the user's foot, the second end being configured for releasably supporting and launching a target object in the air for the user to attempt to catch, wherein each of the first and second ends have distinct indicia for indicating where a user stomps and where a user places the target object, respectively, further wherein the second length portion of the pivoting board is greater that the first length portion of the pivoting board;

a fulcrum connector pivotally attaching the pivoting board to the upper surface of the base;

a first pad mounted on the upper surface of the base adjacent the front area of the rear portion and spaced from the pair of visual indicators, the first pad being located beneath the first end of the pivoting board, such that the first end of the pivoting board selectively contacts and rests on the first pad; and a second pad mounted on the upper surface of the base adjacent the front end of the elongated front portion and beneath the second end of the pivoting board, such that the second end of the pivoting board selectively contacts and rests on the second pad.

* * * * *